US006338762B1

(12) United States Patent
Sato et al.

(10) Patent No.: US 6,338,762 B1
(45) Date of Patent: Jan. 15, 2002

(54) STAINLESS STEEL FOR USE IN ENGINE GASKETS AND A METHOD FOR MANUFACTURING THEREOF

(75) Inventors: Naoto Sato, Funabashi; Kazuhiko Adachi, Jyoetsu; Kenichi Goshokubo, Niigata; Takashi Katsurai, Tochigi; Shigeki Muroga, Utsunomiya, all of (JP)

(73) Assignee: Sumitomo Metal Industries, Ltd., Tokyo (JP)

( * ) Notice: Subject to any disclaimer, the term of this patent is extended or adjusted under 35 U.S.C. 154(b) by 0 days.

(21) Appl. No.: 09/564,649

(22) Filed: May 3, 2000

Related U.S. Application Data

(63) Continuation of application No. PCT/JP99/04774, filed on Sep. 3, 1999.

(30) Foreign Application Priority Data

Sep. 4, 1998 (JP) ..... 10-251302

(51) Int. Cl.[7] ..... C21D 8/00; C21D 9/00; C22C 38/40

(52) U.S. Cl. ..... 148/325; 148/327; 148/605; 148/610; 148/611; 148/651

(58) Field of Search ..... 148/505, 610, 148/651, 611, 654, 325, 327

(56) References Cited

U.S. PATENT DOCUMENTS

| | | | |
|---|---|---|---|
| 4,564,566 A | 1/1986 | Jerlich et al. | |
| 5,118,576 A | 6/1992 | Imae et al. | |
| 5,624,504 A | 4/1997 | Miyakusu et al. | |

FOREIGN PATENT DOCUMENTS

| | | | |
|---|---|---|---|
| EP | 0273278 | | 7/1988 |
| JP | 55-110758 | | 8/1980 |
| JP | 63-162818 A | * | 7/1988 |
| JP | 4-210453 | | 7/1992 |
| JP | 4-214841 | | 8/1992 |
| JP | 5-117813 | | 5/1993 |
| JP | 5-279802 | | 10/1993 |
| JP | 7-003406 | | 1/1995 |
| JP | 7-278758 | | 10/1995 |
| JP | 9-143633 | | 6/1997 |

* cited by examiner

*Primary Examiner*—Deborah Yee
(74) *Attorney, Agent, or Firm*—Burns, Doane, Swecker & Mathis, LLP

(57) ABSTRACT

An austenitic stainless steel for use in engine gaskets having a high fatigue strength and resistance to settlement and method of manufacture thereof. The austenitic stainless steel is prepared by cold rolling at least 40%, annealing at a temperature of 700° C. to 900° C. followed by temper rolling with a reduction of at least 40%. The metal structure obtained by annealing is a recovered unrecrystallized structure or a mixed structure of a recovered unrecrystallized structure and a recrystallized structure. The austenitic stainless steel includes at most 0.03% C, at most 1.0% Si, at most 2.0% Mn, 16.0% to 18.0% Cr, 6.0% to 8.0% Ni and up to 0.20% N.

15 Claims, 1 Drawing Sheet

STAINLESS STEEL FOR USE IN ENGINE GASKETS AND A METHOD FOR MANUFACTURING THEREOF

This application claims priority under 35 U.S.C §§119 and/or 365 to Japanese patent application No. 251302 filed on Sep. 4, 1998; the entire content of which is hereby incorporated by reference.

This Application is a Continuation Application in the U.S.A. of PCT/JP99/04744, filed Sep. 3, 1999 in Japan.

TECHNICAL FIELD

This invention relates to a stainless steel for use in engine gaskets and to a method for its manufacture, and particularly to a stainless steel for manufacturing an engine gasket which has excellent fatigue strength and excellent ability to maintain the shape of a bead potion when a stress load is applied for a long period and to a method for its manufacture.

The present invention also relates to a gasket which is obtained in that manner.

TECHNICAL BACKGROUND

In the past, asbestos and the like have been used as gasket materials for use in apparatuses which increase in temperature, such as engines for use in automobiles or in boats. Recently, in response to increases in engine performance and moves to regulate the use of asbestos by laws, gaskets made of metal, i.e., metal gaskets, have come to be used.

Metal gaskets for use in engines must have various properties necessary for maintaining airtightness of joining surfaces. For example, metal gaskets used in the engines of automobiles, motorcycles, etc. must have properties enabling them to withstand the characteristic varying stresses of engines which are repeatedly applied in an atmosphere of combustion gas.

From the standpoint of sealing materials having similar uses, metal packings are increasingly used in place of O-rings wrapped in asbestos in response to moves to restrict the use of asbestos by laws as described above. In this case, a strip-shaped metal coil is wrapped into the shape of a cylinder, and it is formed into a donut-shaped O-ring to obtain a metal packing.

In the past, SUS301 (AISI301) type steel, which is a work hardened metastable austenite stainless steel which is given a high strength by simply performing cold working, was used as a raw material for these metal gaskets, metal packings, and the like.

For metal gaskets, a sheet having a thickness on the order of 0.1–0.4 millimeters is used as a raw material. In the case of a gasket for use in an engine head, for example, a bead is formed in the periphery of the combustion chamber and in the periphery of water supply holes and oil supply holes, and gas, water, and oil are sealed by the high pressure which is generated when clamping down of the bead is performed. For metal packings, a strip-shaped coil is wrapped into the shape of a cylinder, it is formed into the shape of a donut to form an O-ring, and it is used to maintain the airtightness of a joining surface.

Below, in this specification, such metal gaskets and metal packings will be generically referred to for convenience as "gaskets" or "engine gaskets", and stainless steels used therein will be referred to as "stainless steels for engine gaskets".

Even in the past, there were disclosures concerning gasket materials for use in engines in, for example, Japanese Published Unexamined Patent Application No. HEI 4-214841, Japanese Published Unexamined Patent Application No. HEI 5-279802, and Japanese Published Unexamined Patent Application No. HEI 5-117813.

The stainless steels for engine gaskets disclosed in these official publications are all ones which are imparted with prescribed properties of fine, uniform recrystallized grains having an average grain diameter of at most 10 micrometers by performing finishing intermediate rolling at a reduction ratio of at least 50% followed by low temperature, short duration finish annealing.

DISCLOSURE OF THE INVENTION

Namely, this existing technology relates to methods of manufacturing a stainless steel having excellent formability and fatigue properties characterized by using an austenitic stainless steel having components corresponding to SUS301, and by grain refining thereof by causing recrystallization by carrying out annealing at as low a temperature as possible.

However, at present, the properties of engines are continuously improving, and simultaneous with the trend towards higher engine output, the level of properties required of gasket materials has been increasing. However, there are various problems such as that it is difficult to obtain a material which has a fatigue strength which can adequately withstand this trend towards high engine output, that the final product has an inadequate hardness when a low carbon content is used, and that the shape maintaining ability of the portion which is subjected to working to form a bead when stress is applied for long periods (referred to below as resistance to settlement) is inadequate.

An object of this invention is to provide a stainless steel which is suitable for gaskets used in today's increasingly high performance engines and to a method for its manufacture.

Another object of this invention is to provide an engine gasket which can exhibit that type of excellent performance.

A more specific object of the present invention is to provide a stainless steel for engine gaskets which does not use materials requiring special components but which uses SUS301L stainless steel (roughly corresponding to low carbon AISI301) made of ordinary components and which has properties superior to those of existing materials, i.e., a high fatigue strength and excellent resistance to settlement, and to a method for its manufacture.

For example, a metal gasket used in an automotive engine or the like is subjected to working to form a bead. It is then mounted on an engine block, and it is repeatedly subjected to stress accompanying engine operation (explosions within the cylinders). Therefore, it is required to have adequate fatigue strength to resist this, and it is required to maintain the shape of the bead under such varying stress and to maintain a gas seal, i.e., it is required to have resistance to settlement.

An example of a steel which can cope with such conditions is a stainless steel corresponding to SUS301. As described above, such steels are generally used at present. Among the problems that were seen with such existing technology are the following:

1. In the case of a high carbon steel such as SUS301 (C: at most 0.15%), it is relatively easy to obtain a high hardness and to improve resistance to settlement. However, the more the hardness is increased, the more the fatigue strength ends up decreasing when working to obtain a bead is performed in order to prepare an engine gasket, so it is difficult to obtain both fatigue strength and resistance to settlement. In addition, as a problem during the manufacturing stage, there is the possibility of carbides precipitating due to annealing, and there is a fear of a deterioration of corrosion resistance.

2. In the case of a low C content such as C: at most 0.03%, the corrosion resistance is excellent, and it is possible to increase the fatigue strength to a certain extent, but it is difficult to obtain an adequate hardness. For this reason, it is difficult to obtain an adequate resistance to settlement, and there is fear of a decrease in gas sealing properties.

3. Even higher fatigue strength and resistance to settlement are demanded due to increases in engine power, but with the existing technology using SUS301 type steel, it is difficult to achieve both at the same time, and at present, an increase in performance above existing levels is difficult.

The present inventors found that a sufficient level of hardness can be achieved even for a low carbon steel when temper rolling is carried out on a steel having a mixed structure of a recrystallized structure and a recovered, unrecrystallized structure, or a recovered, unrecrystallized structure corresponding to the structure before recrystallization occurs, which structure is prepared by finish annealing prior to temper rolling in order to reduce the influence of prior working. They also found that due to the remaining effects of previous working, if the strain due to working which is applied to the material after temper rolling has the same working rate as in an existing method, the deformation applied to crystal grains can be made large, and the effect of crystal grain boundaries in the structure on fatigue strength can be decreased. They additionally found that due to these synergistic effects, the fatigue strength can be markedly increased compared to that of existing materials.

The present invention is a stainless steel for engine gaskets characterized by comprising a temper rolled metal structure in the form of a recovered unrecrystallized structure or a mixed structure of a recovered unrecrystallized structure and a recrystallized structure. Namely, a stainless steel for engine gaskets according to the present invention comprises a martensite-containing structure obtained by temper rolling of a recovered unrecrystallized structure, or of a mixed structure of a recovered unrecrystallized structure and a recrystallized structure, both being obtained by annealing.

In this manner, a stainless steel for engine gaskets according to the present invention is one derived from a recovered unrecrystallized structure or a mixed structure of a recovered unrecrystallized structure and a recrystallized structure, both of which are obtained by finish annealing. The crystal structure of the metal structure at this time has a half-value width for the X-ray diffraction measured using CuK $\alpha$ radiations for (220), (311) planes on austenite matrix of at least 0.15° and at most 0.35°.

From another standpoint, the present invention is a method of manufacturing a stainless steel plate for engine gaskets, in which cold rolling and annealing are repeatedly performed after hot rolling, and then temper rolling is performed, characterized in that the reduction during cold rolling carried out before finish annealing is at least 40%, the subsequently performed finish annealing is carried out in a temperature range of at least 700° C. and at most 800° C., and the metal structure is made a recovered unrecrystallized structure.

At this time, by carrying out finish annealing in a temperature range of at least 700° C. and at most 900° C., the metal structure can be made a recovered unrecrystallized structure or a mixed structure of a recovered unrecrystallized structure and a recrystallized structure.

By making the reduction in the temper rolling after finish annealing at least 40%, the formation of martensite can be promoted.

Steels which are the object of the present invention are austenitic stainless steels, and particularly steels corresponding to SUS301(AISI301), and preferably, they are steels containing, by weight percent, C: at most 0.03%, Si: at most 1.0%, Mn: at most 2.0%, Cr: at least 16.0% and at most 18.0%, Ni: at least 6.0% and at most 8.0%, and N: at most 0.20%.

From yet another standpoint, the present invention is an engine gasket made from a stainless steel having a temper rolled metal structure in which the metal structure is a recovered unrecrystallized structure or a mixed structure of a recovered unrecrystallized structure and a recrystallized structure.

In this manner, according to the present invention, a high hardness with a low C material which could not be obtained with existing technology is made possible, and an improvement in resistance to settlement can be obtained.

In addition, according to the present invention, using a stainless steel having components corresponding to generally known SUS301L, a stainless steel for engine gaskets having high fatigue strength and excellent resistance to settlement and a method for its manufacture are provided.

BEST MODE FOR CARRYING OUT THE INVENTION

Figure 1:
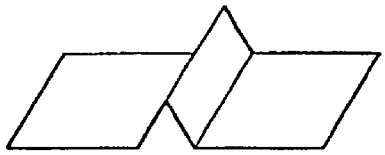
FIG. 1 is an explanatory view of the shape of a bead of a sample subjected to a fatigue test and a resistance to settlement test.

An outline of the reasons for the limitations of an example of a suitable composition of a stainless steel used in the present invention will be described below.

In general, a stainless steel used in the present invention can be SUS301L prescribed by JIS G 4305. Similar regulations are prescribed in U.S. Standards, or European Standards EN10088-1.

In a suitable mode of the present invention, the composition of such a stainless steel is prescribed as follows.

C is an austenite-forming element, it restricts delta-ferrite which is formed at high temperatures, and it is extremely effective for strengthening a martensite phase which is induced by cold working. However, if the C content is too high, work hardening becomes extreme, and during cold rolling it becomes difficult to regulate so as to achieve a target plate thickness, and manufacturability is worsened. In addition, there is a fear of deterioration in corrosion resistance accompanying precipitation of carbides due to annealing performed prior to temper rolling. Therefore, the range of C is preferably at most 0.03%. There is no particular lower limit, but in order to guarantee a prescribed strength, it is preferably at least 0.01%.

Si is added as a deoxidizing agent. In austenitic stainless steel, it is normally contained in an amount of about at most 1.0%. Therefore, in the present invention as well, Si is at most 1.0%.

Mn is an austenite-forming element. It is normally contained in an amount of about 2.0%, so in the present invention as well, Mn is at most 2.0%.

Cr is an indispensable component for guaranteeing a prescribed corrosion resistance. In order to impart a desired corrosion resistance and heat resistance, the amount is at least 13%. However, Cr is a ferrite-forming element, so if the amount is made too high, a large amount of delta-ferrite ends up being formed at high temperatures. On the other hand, if a large amount of an austenite-forming element is added to suppress a delta-ferrite phase, the austenite phase is stabilized at room temperature, and a high strength can not be obtained after cold working. From these standpoints, the range of Cr is preferably at least 16.0% and at most 18.0%.

Ni is an indispensable component for obtaining an austenite phase at high temperatures and at room temperature, but in the case of the present invention, it is added so as to obtain metastable austenite at room temperature, and so as to obtain an increase in strength due to work hardening accompanying the martensite transformation occurring during temper rolling.

If the amount of Ni is less than 6.0%, a large amount of delta-ferrite is formed at high temperatures, and it becomes easy for an excessive amount of work-induced martensite phase to be formed, hardening progresses, and elongation decreases. On the other hand, if the amount of Ni exceeds 8.0%, the austenite phase becomes stable, and it becomes difficult for a work induced martensite phase to form, so it is difficult to obtain sufficient hardness.

For this reason, the amount of Ni is at least 6.0% and at most 8.0%. From the standpoint of durability and heat resistance, it is also advantageous for the amount of Ni which is added to be at least 6.0%. However, if the added amount exceeds 8%, costs increase and the effect thereof saturates. From this standpoint as well, the amount of Ni is at least 6.0% and at most 8.0%.

Like C, N is an austenite-forming element, and it is an element which is effective for hardening a martensite phase and an austenite phase. In addition, compared to C, it does not readily form precipitates, so the addition of N is also effective from the standpoints of formability and fatigue strength. Also, it acts as a nucleus for recrystallization during annealing, and it is effective for refining the structure. However, if it is added in a large amount, it becomes a cause of blowholes, and during heat treatment, edge cracks are easily induced. Accordingly, in the present invention, it is preferably added in an amount of at most 0.20%. There is no particular lower limit thereon, but in order to obtain a desired effect, it is preferably at least 0.10%.

In a method of manufacturing a stainless steel according to the present invention, as a steel which meets these conditions, a stainless steel which corresponds to SUS301L set forth in generally known JIS G 4305 is applicable, but in this case, it is also possible for it to contain a certain amount of added elements, such as Mo, Cu, Nb, and the like other than those prescribed by JIS G 4305 with respect to SUS301L.

In the present invention, in the annealing which is carried out prior to temper rolling, the metal structure is made a recovered unrecrystallized crystal structure which occurs prior to recrystallization or a mixed structure of recrystallized grains and recovered unrecrystallized grains, and the amount of deformation of grains in the subsequent temper rolling is increased, and the effect of crystal grain boundaries on fatigue strength is made extremely small, as a result of which the fatigue strength is of course increased, and the ability to maintain shape (resistance to settlement) after working due to a high hardness being attained is enormously improved.

In the case of the present invention, it is not particularly necessary to perform aging such as is generally carried out, but if aging is additionally performed, a material of even higher strength is of course obtained.

In this manner, according to the present invention, it is possible to manufacture a gasket material having a higher fatigue strength and superior resistance to settlement compared to existing materials.

Here, the reasons for the limitations on a manufacturing method according to this invention will be described in more detail.

The structural state of a stainless steel used in this invention is essentially an austenite structure at the time of solution treatment. In the rolling performed prior to finish annealing prior to temper rolling of this steel, namely during finishing intermediate rolling, cold rolling with a reduction of at least 40% and preferably from 40 to 70% is carried out. As a result, in finish annealing prior to temper rolling, by performing finish annealing at a relatively low annealing temperature, i.e., in a temperature range of at least 700° C. and at most 800° C. or at least 700° C. and at most 900° C., a recovered unrecrystallized structure or a mixed structure of recrystallized grains and a recovered unrecrystallized structure is obtained, and then by carrying out cold working of at least 40% in the subsequently performed temper rolling, a metal gasket material having sufficient properties can be obtained.

The soaking time during finish annealing at this time is preferably from 0 to 60 seconds. If it exceeds 60 seconds, there is the possibility of an entirely recrystallized structure.

Here, the finish annealing prior to temper rolling is particularly restricted to at least 700° C. and at most 800° C. or at least 700° C. and at most 900° C. This is because if the temperature is less than 700° C., a long time is required for recovery in order to decrease the effects of previous working, which is not industrially practical. If the temperature exceeds 800° C., a recrystallized structure begins to form. In addition, if the temperature exceeds 900° C., the structure ends up being almost entirely a recrystallized structure.

There is no particular limit on the percentage of recovered unrecrystallized grains, but in order to obtain necessary properties, it is desirable that it be at least 50%.

In this manner, according to the present invention, due to finish annealing carried out prior to temper rolling, the metal structure is made a recovered unrecrystallized structure or a mixed structure of recrystallized grains and a recovered unrecrystallized structure. The reason for this is to increase the work induced strain applied to the material after temper rolling which is subsequently performed because of the remaining effects of previous working, to increase the deformation which is thereby applied to grains, to make the effect on crystal grain boundaries as small as possible, and to improve the fatigue strength after bead formation. In addition, this is in order to obtain a material of higher hardness, and to improve the resistance to settlement of the bead portion.

The finish annealing can be carried out on an industrial scale using a continuous annealing equipment.

The above-described recovered unrecrystallized structure or the mixed structure of recrystallized grains and a recovered unrecrystallized structure is one having a crystal structure in which each half-value width of (220), (311) on austenite matrix is at least 0.15° and at most 0.35° by X-ray diffraction measured using CuK $\alpha$ radiation.

The metal structure which is obtained at this time can be made entirely into a recovered unrecrystallized structure by making the annealing temperature during finish annealing 700 to 800° C.

After finish annealing, temper rolling is carried out. Due to the remaining effects of prior working, a rolling reduction of at least 40% is sufficient, and a large increase in fatigue strength and a high strength can be obtained. In the present invention, the rolling reduction of this temper rolling can be set to various values within the range of at least 40%, but even with the same rolling reduction as used with existing steels, a material of higher fatigue strength and superior resistance to settlement can be obtained.

In this manner, according to the present invention, it is possible to provide the properties necessary for an engine gasket material, so aging which is generally carried out to obtain an increase in strength is not necessary, but if aging is performed, a material of even higher performance can of course be obtained.

The metastable austenite stainless steel which is the object of the present invention exhibits an austenite phase in solid solution, so the manufacturing steps prior to finishing intermediate rolling performed prior to finish annealing can be the same as for existing materials.

Next, the effects of the present invention will be shown in greater detail by an example.

EXAMPLE

Table 1 shows the components of a stainless steel used in this example.

Table 2 shows the mechanical properties, the half-value width of X-ray diffraction, the fatigue strength, and the resistance to settlement when the rolling reduction in cold rolling performed prior to finish annealing preceding temper rolling, the annealing conditions, and the temper rolling reduction were varied.

Each of the steels shown in FIG. 1, i.e., the steels of the present invention (1–3), and the comparative steels (4–6) were melted in an ordinary atmospheric melting furnace, were subjected to hot rolling followed by cold rolling and annealing, and then were formed by temper rolling to a thickness of 0.20 millimeters. Samples were then collected from the steels. In each case, finish annealing was carried out by maintaining the steels for 10 seconds (soaking time) after a set temperature was reached. The details of the rolling reduction in finishing intermediate rolling prior to finish annealing, the annealing conditions, and the temper rolling reduction for each steel are shown in Table 2.

The collected samples were subjected to a tensile test and a hardness test to measure their mechanical properties, and they were subjected to a fatigue test and a settlement test to evaluate their fatigue strength and their resistance to settlement.

FIG. 1 is a schematic perspective view showing a test piece for the fatigue test and the resistance to settlement test and particularly the shape of the bead.

Figure 2:
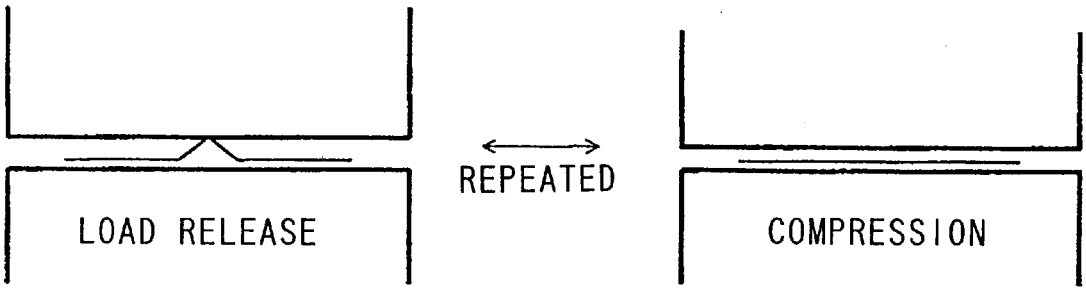
FIG. 2 is a view explaining the essentials of the fatigue test and the resistance to settlement test.

FIG. 2 is a view for explaining the essentials of the repeated compression and load release carried out in the fatigue test and the resistance to settlement test.

In this example, the bead had a width of 2.5 millimeters and a height of 0.25 millimeters. In the fatigue test, a test piece on which this bead portion was formed was repeatedly loaded from above and below as shown in FIG. 2, and after compression and release of a load were repeated $10^6$ times, the fatigue strength was evaluated based on whether cracks were formed in the test piece. Those with no change are shown by a circle, and those which suffered cracking or fracture are indicated by an X.

Similarly, in the resistance to settlement test, compression and release of load were repeated $10^5$ times, after which those having a ratio ($h/h_o$) of the remaining bead height h to the initial bead height h of at least 0.5 were evaluated as good and those of less than 0.5 were evaluated as bad, and are respectively shown by a circle and by an X.

Those having good formability when the formation of a bead shown in FIG. 1 was carried out are indicated by a circle, and those in which cracking or fracture took place are indicated by an X.

In order to determine the state of the metal structure of the material obtained after finish annealing, measurement of the half-value width by X-ray diffraction using CuK $\alpha$ radiation was carried out on the materials after finish annealing.

The results are collectively shown in Table 2.

TABLE 1

Remainder: Fe (weight %)

| | Steel Number | C | Si | Mn | S | Ni | Cr | N | Nb | Mo | Cu | Remarks |
|---|---|---|---|---|---|---|---|---|---|---|---|---|
| Present Invention | 1 | 0.023 | 0.59 | 1.61 | 0.002 | 6.70 | 17.22 | 0.115 | 0.068 | 0.28 | 0.31 | Corresponds to SUS301L |
| | 2 | 0.011 | 0.52 | 1.43 | 0.001 | 6.65 | 17.89 | 0.124 | 0.071 | 0.20 | 0.18 | |
| | 3 | 0.013 | 0.48 | 1.35 | 0.003 | 7.08 | 16.28 | 0.159 | 0.065 | 0.19 | 0.20 | |
| Comparative | 4 | 0.099* | 0.57 | 0.81 | 0.003 | 6.74 | 17.01 | 0.061* | 0.007 | 0.26 | 0.27 | Corresponds to SUS301 |
| | 5 | 0.053* | 0.37 | 0.92 | 0.002 | 8.02* | 18.19* | 0.034* | 0.009 | 0.21 | 0.19 | Corresponds to SUS304 |
| | 6 | 0.017 | 0.33 | 0.98 | 0.002 | 9.01* | 18.16* | 0.031* | 0.008 | 0.18 | 0.18 | Corresponds to SUS304L |

(Note)
*: Indicates outside the range prescribed by the present invention.

TABLE 2

| | | | Manufacturing Conditions | | | Results | | | | | | | |
|---|---|---|---|---|---|---|---|---|---|---|---|---|---|
| | Example Number | Steel Number | Finish Rolling (%) | Finish Annealing (° C.) | Temper Rolling (%) | 0.2% Yield Strength ($N/mm^2$) | Tensile Strength ($N/mm^2$) | Elong-ation (%) | Half-Value Width (°) | Fatigue Strength | Hard-ness (Hv) | Resistance to Settlement | Forma-bility |
| Present Inven-tion | 1 | 1 | 50 | 800 | 50 | 1290 | 1424 | 8.0 | 0.20 | ○ | 454 | ○ | ○ |
| | 2 | 2 | 50 | 800 | 50 | 1285 | 1422 | 8.3 | 0.20 | ○ | 451 | ○ | ○ |
| | 3 | 3 | 50 | 800 | 50 | 1284 | 1420 | 8.3 | 0.20 | ○ | 453 | ○ | ○ |
| | 4 | 1 | 40 | 800 | 50 | 1289 | 1427 | 8.0 | 0.21 | ○ | 450 | ○ | ○ |
| | 5 | 1 | 60 | 800 | 50 | 1302 | 1441 | 7.4 | 0.23 | ○ | 456 | ○ | ○ |
| | 6 | 1 | 50 | 700 | 50 | 1390 | 1504 | 4.6 | 0.35 | ○ | 458 | ○ | ○ |
| | 7 | 1 | 50 | 900 | 50 | 1285 | 1410 | 9.8 | 0.18 | ○ | 440 | ○ | ○ |
| | 8 | 1 | 50 | 800 | 40 | 1274 | 1408 | 9.2 | 0.20 | ○ | 450 | ○ | ○ |
| | 9 | 1 | 50 | 800 | 60 | 1301 | 1431 | 7.7 | 0.20 | ○ | 457 | ○ | ○ |
| Com-parative | 10 | 4 | 40 | 800 | 40 | 1431 | 1675 | 1.9 | 0.42* | — | 520 | — | X |
| | 11 | 5 | 40 | 800 | 40 | 1390 | 1514 | 1.8 | 0.41* | X | 434 | X | ○ |
| | 12 | 6 | 40 | 800 | 40 | 1262 | 1389 | 4.4 | 0.40* | X | 391 | X | ○ |
| | 13 | 1 | 30* | 800 | 50 | 1406 | 1525 | 3.6 | 0.38* | — | 460 | — | X |
| | 14 | 1 | 50 | 675* | 50 | 1418 | 1541 | 2.8 | 0.39* | — | 462 | — | X |
| | 15 | 1 | 50 | 925* | 50 | 1250 | 1393 | 11.8 | 0.14* | X | 429 | X | ○ |

(Note)
*: Indicates outside the range prescribed by the present invention.

Possibility of Industrial Use

According to the present invention, a stainless steel for use in engine gaskets having superior fatigue strength and resistance to settlement is obtained. A manufacturing method according to this invention reduces the effects of prior working on the metal structure after finish annealing performed prior to temper rolling, and by making a recovered unrecrystallized structure prior to the occurrence of recrystallization or a mixed structure of recrystallized grains and a recovered unrecrystallized structure, compared to other manufacturing methods using existing metal gasket materials in the form of SUS30 1-type steels, it is possible to manufacture a material having both a high fatigue strength and resistance to settlement. A manufacturing method for a stainless steel for engine gaskets of this type according to the present invention having such properties can be carried out using a stainless steel with generally well-known components using existing equipment, and finish annealing prior to temper rolling can be easily carried out on a continuous annealing line, so the manufacturing method provides excellent economy.

What is claimed is:

1. An austenitic stainless steel for use in engine gaskets characterized by having a structure in which the half-value width by X-ray diffraction measured using CuK α radiation for (220), (311) planes on austenite matrix is at least 0.15° and at most 0.35°, and wherein the stainless steel contains, by weight percent, C: at most 0.03%, Si: at most 1.0%, Mn: at most 2.0%, Cr: at least 16.0% and at most 18.0%, Ni: at least 6.0% and at most 8.0% and N: at most 0.20%.

2. An austenitic stainless steel for use in engine gaskets characterized by having a temper rolled metal structure which is a recovered unrecrystallized structure or a mixed structure of a recovered unrecrystallized structure and a recrystallized structure, and wherein the stainless steel contains, by weight percent, C: at most 0.03%, Si: at most 1.0%, Mn: at most 2.0%, Cr: at least 16.0% and at most 18.0%, Ni: at least 6.0% and at most 8.0%, and N: at most 0.20%.

3. An austenitic stainless steel for use in engine gaskets characterized by having a martensite-containing metal structure obtained by performing a temper rolling after obtaining by annealing a recovered unrecrystallized structure or a mixed structure of a recovered unrecrystallized structure and a recrystallized structure, and wherein the stainless steel contains, by weight percent, C: at most 0.03%, Si: at most 1.0%, Mn: at most 2.0%, Cr: at least 16.0% and at most 18.0%, Ni: at least 6.0% and at most 8.0%, and N: at most 0.20%.

4. A method of manufacturing an austenitic stainless steel plate for use in engine gaskets in which annealing after cold rolling of a steel plate are repeated after hot rolling, and then temper rolling is performed, characterized in that the rolling reduction of cold rolling carried out prior to finish annealing is at least 40%, and finish annealing which is then performed is carried out in a temperature range of at least 700° C. and at most 800° C. to make the metal structure a recovered unrecrystallized structure.

5. A method of manufacturing an austenitic stainless steel for use in engine gaskets as claimed in claim 4, characterized by carrying out the finish annealing in a temperature range of at least 700° C. and at most 900° C. and making the metal structure a recovered unrecrystallized structure or a mixed structure of a recovered unrecrystallized structure and a recrystallized structure.

6. An engine gasket made from an austenitic stainless steel having a temper rolled metal structure which is a recovered unrecrystallized structure or a mixed structure of a recovered unrecrystallized structure and a recrystallized structure, and wherein the stainless steel contains, by weight percent, C: at most 0.03%, Si: at most 1.0%, Mn: at most 2.0%, Cr: at least 16.0% and at most 18.0%, Ni: at least 6.0% and at most 8.0%, and N: at most 0.20%.

7. A method of manufacturing an austenitic stainless steel for use in engine gaskets, characterized by carrying out the finish annealing in a temperature range of at least 700° C. and at most 900° C. and making the metal structure a recovered unrecrystallized structure or a mixed structure of a recovered unrecrystallized structure and a recrystallized structure, and wherein the stainless steel contains by weight percent, C: at most 0.3%, Si: at most 1.0%, Mn: at most 2.0%, Cr: at least 16.0% and at most 18.0%, Ni: at least 6.0% and at most 8.0%, and N: at most 0.20.

8. A gasket made of an austenitic stainless steel as claimed in claim 1.

9. A gasket made of an austenitic stainless steel as claimed in claim 2.

10. A gasket made of an austenitic stainless steel as claimed in claim 3.

11. The austenitic stainless steel as claimed in claim 1, wherein N is 0.10 to 0.20%.

12. The austenitic stainless steel as claimed in claim 2, wherein N is 0.10 to 0.20%.

13. The austenitic stainless steel as claimed in claim 3, wherein N is 0.10 to 0.20%.

14. A method of manufacturing an austenitic stainless steel for use in engine gaskets as claimed in claim 4 wherein the stainless steel contains, by weight percent, C: at most 0.03%, Si: at most 1.0%, Mn: at most 2.0%, Cr: at least 16.0% and at most 18.0%, Ni: at least 6.0% and at most 8.0%, and N: at most 0.20%.

15. A method of manufacturing an austenitic stainless steel for use in engine gaskets as claimed in claim 4, wherein N is 0.10 to 0.20%.

* * * * *

UNITED STATES PATENT AND TRADEMARK OFFICE

CERTIFICATE OF CORRECTION

PATENT NO. : 6,338,762 B1
DATED : January 15, 2002
INVENTOR(S) : Naoto Sato et al.

It is certified that error appears in the above-identified patent and that said Letters Patent is hereby corrected as shown below:

Title page,
Assignee information is corrected to read:

-- [73] Assignees: Sumitomo Metal Industries, Ltd.,
Osaka (JP)

Honda Giken Kogyo Kabushiki Kaisha
Tokyo (JP) --

Signed and Sealed this

Twenty-ninth Day of October, 2002

*Attest:*

*Attesting Officer*

JAMES E. ROGAN
*Director of the United States Patent and Trademark Office*